United States Patent [19]

Herrington, Jr.

[11] Patent Number: 4,512,476

[45] Date of Patent: Apr. 23, 1985

[54] PLASTIC BAG DISPENSER

[75] Inventor: F. John Herrington, Jr., Holcomb, N.Y.

[73] Assignee: Mobil Oil Corporation, New York, N.Y.

[21] Appl. No.: 566,725

[22] Filed: Dec. 29, 1983

[51] Int. Cl.[3] ..... B65D 83/00; B65H 1/00

[52] U.S. Cl. ..... 206/554; 206/494; 221/63

[58] Field of Search ..... 206/554, 494; 221/63

[56] References Cited

U.S. PATENT DOCUMENTS

| | | | |
|---|---|---|---|
| 1,911,548 | 5/1933 | Campbell . | |
| 1,980,059 | 11/1934 | Housen . | |
| 2,621,788 | 12/1952 | Hitchcock | 221/63 |
| 2,651,409 | 9/1953 | Fay | 221/63 |
| 3,012,692 | 12/1961 | Peterson | 221/63 |
| 3,119,516 | 1/1964 | Donovan | 206/494 |
| 3,145,840 | 8/1964 | Wright . | |
| 3,249,255 | 5/1966 | Cohen | 221/63 |
| 3,304,843 | 2/1967 | Cloud, Jr. . | |
| 3,385,428 | 5/1968 | Kugler . | |
| 3,420,433 | 1/1969 | Bostwick | 206/554 |
| 3,819,043 | 6/1974 | Harrison . | |
| 3,970,215 | 7/1976 | McLaren et al. . | |
| 4,044,919 | 8/1977 | Olson | 221/63 |
| 4,216,863 | 8/1980 | Seymour-Smith . | |

FOREIGN PATENT DOCUMENTS

| | | | |
|---|---|---|---|
| 1312783 | 4/1973 | United Kingdom | 206/554 |

*Primary Examiner*—William T. Dixson, Jr.
*Attorney, Agent, or Firm*—Alexander J. McKillop; Michael G. Gilman; Charles J. Speciale

[57] ABSTRACT

Small bags, such as sandwich bags and food storage bags, are folded in thirds along parallel fold lines and individually inserted into a box-like dispenser. A rupturable line extends along a top and adjacent side edge of the dispenser which, when ruptured, provides an opening in the dispenser at the corner of the top and adjacent side edge to facilitate removal of the folded bags.

3 Claims, 2 Drawing Figures

PLASTIC BAG DISPENSER

BACKGROUND OF THE INVENTION

1. Field of the Invention

The invention relates to a plastic bag dispenser containing folded bags which permits easy dispensing of the folded bags.

2. Description of Prior Art

Consumers have commonly used plastic bags to store food products and sandwiches. Typically, the bags are provided in a dispensing container having an opening permitting bag withdrawal. Unfortunately, the opening is typically provided on a single side of the dispensing container, making it difficult to grab and remove a single bag for use, particularly when plastic bags are involved which are usually inherently slippery. Oftentimes it is also difficult to remove a single bag from a dispensing container because they are interlocked. Thus, more than one bag can be undesirably removed at a time.

SUMMARY OF THE INVENTION

One object of the present invention is the provision of a plastic bag dispenser which facilitates individual bag removal.

Another object of the present invention is the provision of a plastic bag dispenser containing bags which are folded in a manner permitting easy withdrawal of individual bags from the dispenser.

These objects are achieved by a plastic bag dispenser which has a housing containing an opening which is formed as a corner window extending along two adjacent sides of the housing, permitting easy access to folded bags contained therein. The bags are folded into thirds, with a folded portion being exposed by the window to further facilitate bag withdrawal.

DETAILED DESCRIPTION OF THE PREFERRED EMBODIMENT

Figure 1:
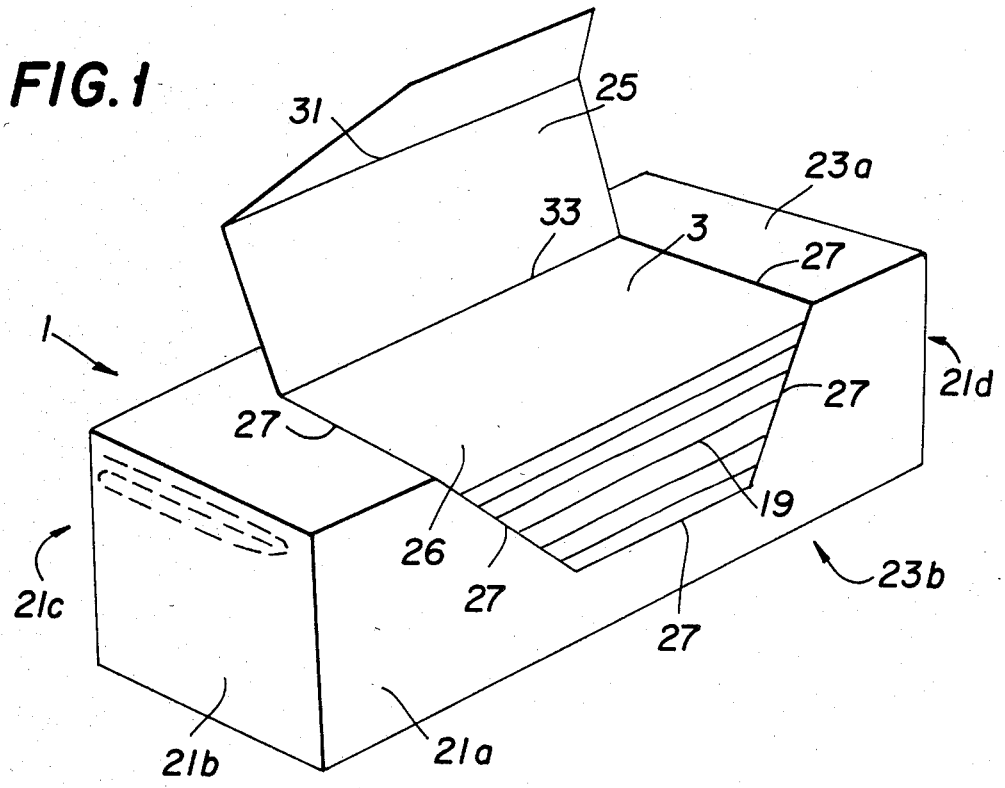
FIG. 1 is a perspective view of the preferred embodiment of a plastic bag dispenser of the present invention.
Figure 2:
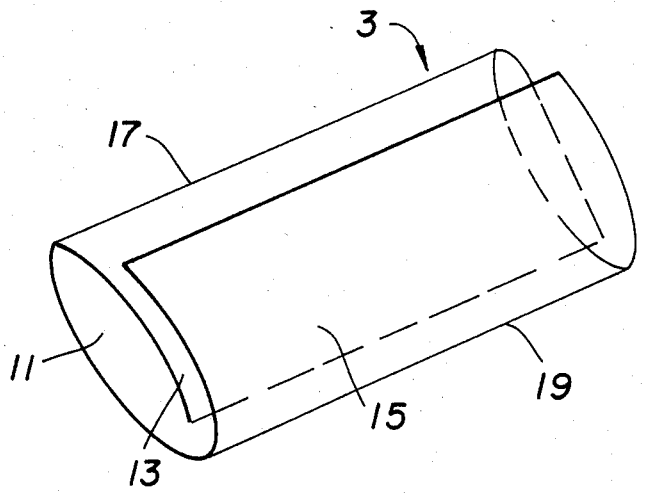
FIG. 2 is a perspective view of a folded plastic bag used in the FIG. 1 dispenser.

FIG. 1 illustrates a preferred embodiment of a plastic bag dispenser of the invention. It comprises a rectangular boxlike housing 1 containing a plurality of folded and stacked plastic bags 3. The plastic bags 3 are stacked within the housing 1, but are not interlocked. The stacked bags are each folded into thirds and are divided into three panels, a first center panel 11, a second left panel 13, and a third right panel 15. The bags are folded in thirds along fold line 17 between the first and second panels 11, 13 and a fold line 19 between first and third panels 11, 15, as shown in FIG. 2. The bags 3 may be made of polyethylene or other suitable plastic materials well known in the art. They may be of various sizes, such as conventional sandwich and food storage bag sizes. All stacked bags 3 are folded in the same direction, as shown in FIGS. 1 and 2, to facilitate easy automatic loading of the bags 3 into housing 1, and removal of the bags by the consumer.

The housing 1 is of a rectangular box-like shape, with four side panels 21*a*, 21*b*, 21*c*, 21*d* and top and bottom panels 23*a*, 23*b*. An opening 26 is formed by means of rupturable perforated edges 27, which extend across portions of the top 23*a* and front side 21*a* of housing 1. When the perforated edges are ruptured, a lid 25 is formed which can be pulled upwardly from housing 1 to form a window-like opening 26 at a corner formed by the top 23*a* and the front side 21*a* of housing 1.

The bags 3 provided in housing 1 extend beyond the length of opening 26 so that they are easily and securely retained within the housing, even though the bags are easily pulled from the housing through the opening 26. Lid 25 is attached to housing 1 along a non-perforated edge 33, another edge in the lid 25 is formed where the side wall 21*a* meets with top 23*a* and this forms a joint edge 31.

The location of opening 26 permits easy access to the bags 3 stored within dispenser 1. A consumer can easily and securely grab an edge fold 19 of a folded bag to withdraw the same from the dispenser. Moreover, since the bags are not interlocked, a single bag is easily removed. Folding the bags into thirds imparts additional thickness to the portion of the bags grabbed by a consumer, enabling a consumer to more easily distinguish one bag from another, thus further facilitating removal of individual bags.

While a preferred embodiment of the invention has been described and illustrated, it should be apparent that many modifications can be made without departing from the spirit and scope of the invention. Accordingly, the invention is not limited by the foregoing description, but is only limited by the scope of the appended claims.

I claim:

1. A plastic bag dispenser comprising a rectangular shaped box-like housing having four sides and a top and bottom and containing a plurality of stacked and folded plastic bags, each of said bags being individually folded within said housing and not interlocked with another bag, said dispenser including a rupturable line extending along said top and an adjacent side edge which, when ruptured, provides an opening in said housing at a corner and extending along said top and adjacent side edge, exposing said bags for removal from said dispenser, said bags being folded into thirds and a fold line of said bags being exposed by said opening.

2. A plastic bag dispenser as in claim 1, wherein said bags extend within said housing beyond the extent of said opening so that said housing retains said bags therein when said line is ruptured to create said opening.

3. A plastic bag dispenser as in claim 1, wherein said bags are one of sandwich bags and food storage bags.

* * * * *